United States Patent [19]

Smart et al.

[11] 4,380,905

[45] Apr. 26, 1983

[54] GAS TURBINE ENGINE COMBUSTION CHAMBERS

[75] Inventors: Richard B. Smart, Mickleover; Sidney E. Slattery, Foston, both of England

[73] Assignee: Rolls-Royce Limited, London, England

[21] Appl. No.: 361,454

[22] Filed: Mar. 24, 1982

Related U.S. Application Data

[63] Continuation of Ser. No. 127,546, Mar. 6, 1980, abandoned.

[30] Foreign Application Priority Data

Mar. 22, 1979 [GB] United Kingdom ..... 791057

[51] Int. Cl.[3] ..... F02G 1/055

[52] U.S. Cl. ..... 60/756

[58] Field of Search ..... 60/756, 757

[56] References Cited

U.S. PATENT DOCUMENTS

| | | | |
|---|---|---|---|
| 3,737,152 | 6/1973 | Wilson | 60/757 |
| 3,916,619 | 11/1975 | Masai et al. | 60/756 |
| 4,085,580 | 4/1978 | Slattery | 60/756 |
| 4,085,581 | 4/1978 | Caruel et al. | 60/756 |
| 4,241,586 | 12/1980 | Caruel et al. | 60/756 |
| 4,242,871 | 1/1981 | Breton | 60/757 |

*Primary Examiner*—Carlton R. Croyle
*Assistant Examiner*—Jeffrey A. Simenauer
*Attorney, Agent, or Firm*—Cushman, Darby & Cushman

[57] ABSTRACT

In order to cool the annular upstream wall of a gas turbine engine combustion chamber and thereby to prevent the deposition of carbon particles, the wall is formed of upstream and downstream portions which between them define a chamber arranged to receive a flow of cooling air. The downstream portion has a central opening for an airspray fuel burner and on each side of the opening the downstream portion has a pair of facets each facet having apertures for the throughflow of cooling air over the face of the downstream portion.

10 Claims, 4 Drawing Figures

GAS TURBINE ENGINE COMBUSTION CHAMBERS

This is a continuation, of application Ser. No. 127,546, filed Mar. 6, 1980, now abandoned.

This invention relates to combustion chambers for gas turbine engines and is particularly concerned with cooling the upstream wall of said chambers, which can be of the annular type, the can-annular or the can-type.

Various arrangements are available for cooling such upstream walls mainly comprising the provision of flow guiding surfaces in the combustion chamber which force a flow of cooling air over the hot upstream wall. Such surfaces themselves tend to run at a high temperature or to collect carbon particles which can accumulate until relatively large pieces of carbon break off and cause damage to the downwstream components of the engine. Also the flow of cooling air can have an adverse effect on the distribution of fuel as it is injected into the combustion chamber.

The present invention seeks to provide a form of construction for the combustion chamber upstream wall which can be effectively cooled whilst minimising the problems referred to above.

According to the present invention there is provided a gas turbine engine combustion chamber having an upstream wall comprising an upstream wall portion and a downstream wall portion attached thereto, the two wall portions defining a chamber arranged to receive a flow of cooling air and to discharge the cooling air therefrom, the downstream wall portion having a plurality of facets set at an angle to the downstream face of the downstream wall portion, each said facet having a plurality of apertures for the through flow of cooling air from said chamber to the said downstream face of the downstream wall portion.

In one specific arrangement, the invention provides an annular combustion chamber for a gas turbine engine having an upstream wall comprising an upstream wall portion and a downstream wall portion attached thereto the downstream wall portion comprising a plurality of arcuate abutting relationship to form a central aperture arranged to receive an airspray fuel burner of the engine and two pairs of facets, one pair on each side of said central aperture, the facets in one pair facing the facets in the opposed pair, each facet having a plurality of apertures for the through flow of cooling air from the chamber formed between the two wall portions to the downstream face of the downstream wall portion.

Figure 1:
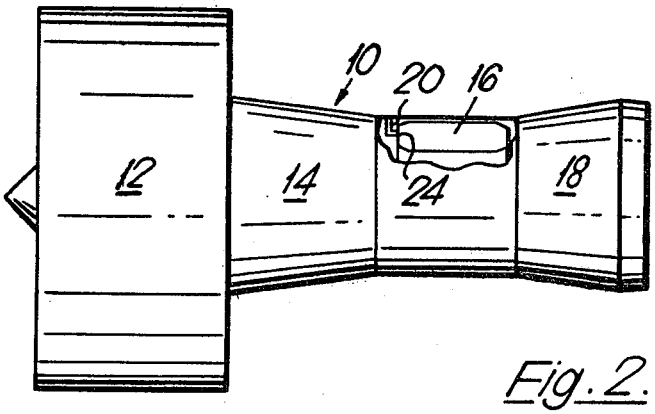
Figure 2:
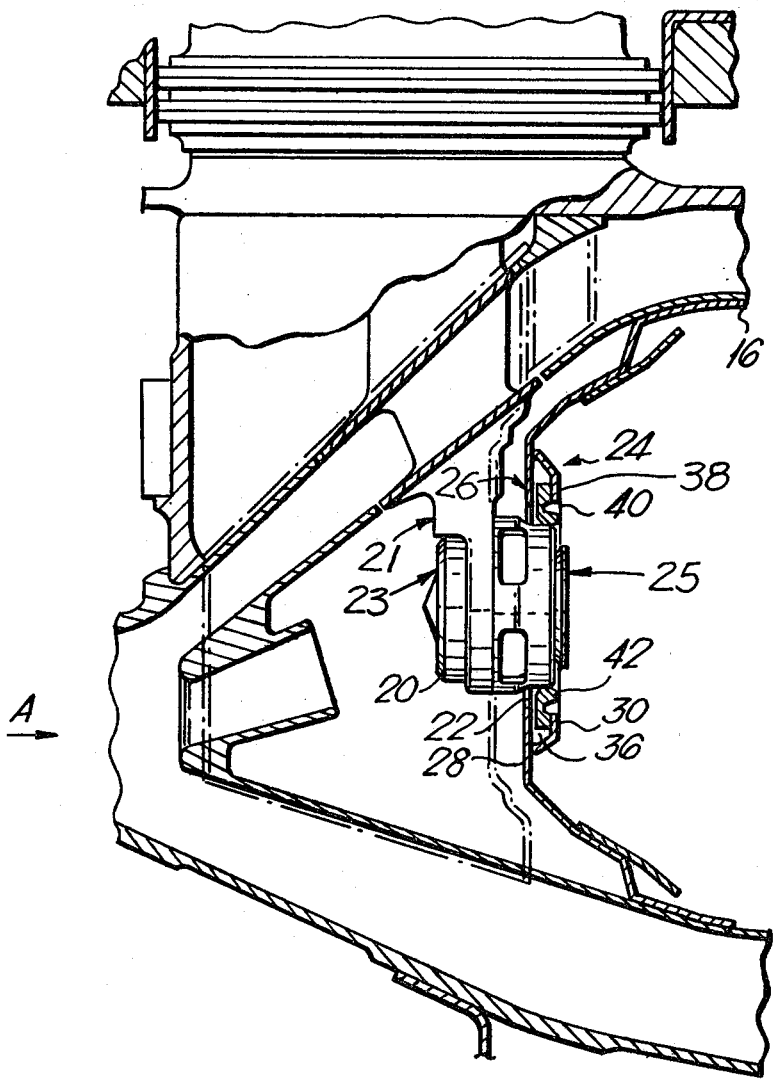
Figure 3:
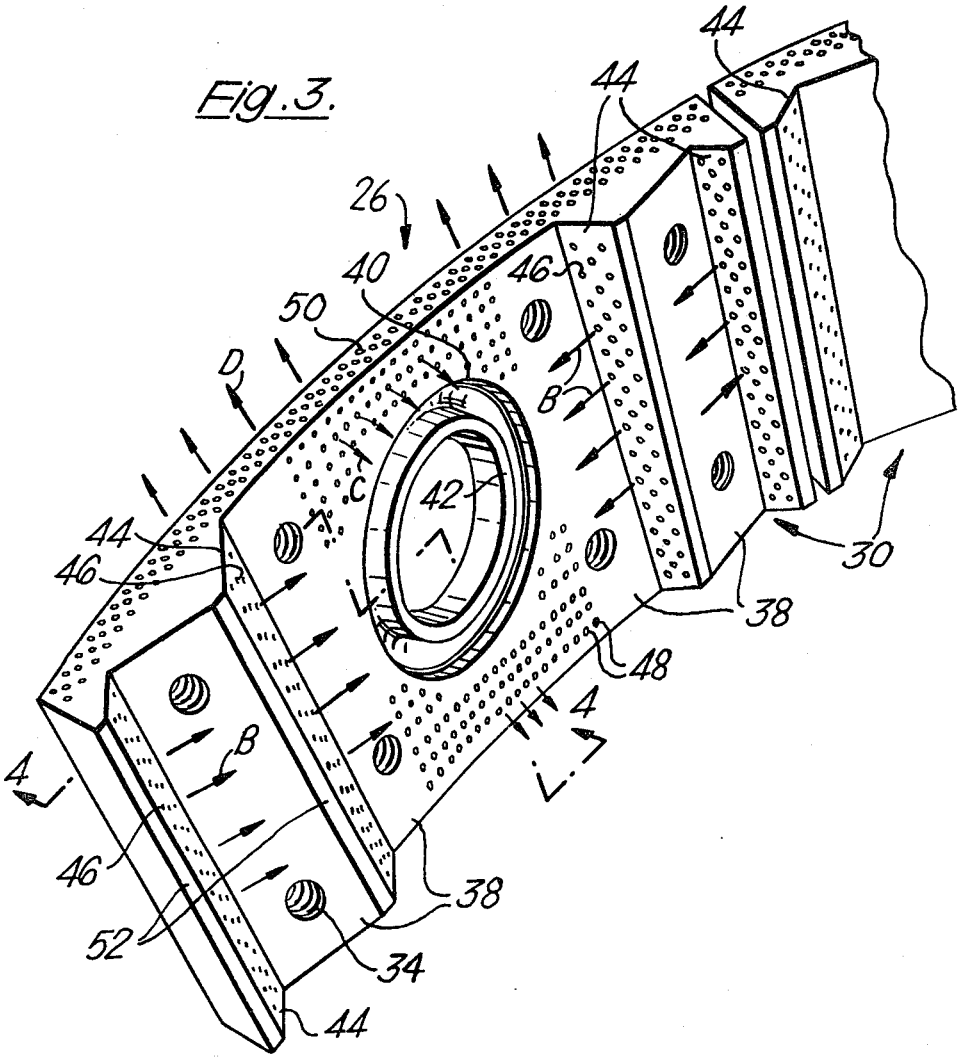
Figure 4:
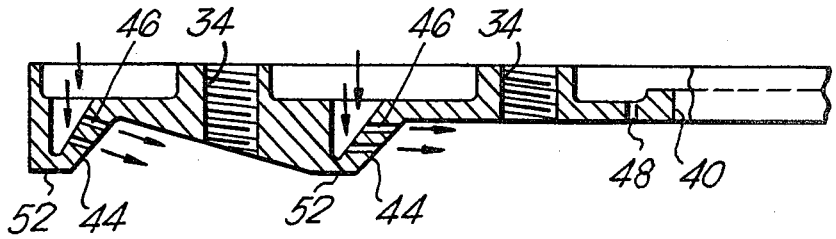

The invention will now be more particularly described with reference to the accompanying drawings in which;

FIG. 1 is a diagrammatic view of a gas turbine engine including one form of combustion chamber according to the present invention, FIG. 2 is a view to an enlarged scale showing in more detail the upstream wall of the combustion chamber shown in FIG. 1, FIG. 3 is a perspective view of part of the downstream wall portion of the upstream wall shown in FIG. 2 and, FIG. 4 is a section of line 4—4 in FIG. 3.

Referring to the Figures, a gas turbine engine 10 comprises in flow series, a fan 12, a compressor 14, an annular combustion chamber 16 and a turbine 18, the fan being driven by one section of the turbine and the compressor being driven by the remaining section of the turbine.

A number of air spray fuel burners 20 pass through the engine casing and co-operate with apertures 22 in the upstream wall 24 of the combustion chamber 16 and compressor delivery air from the compressor 14, some of which is used to cool the combustion chamber whilst the remainder is used in the combustion process flows in the direction of arrow A (FIG. 2) from an upstream to a downstream direction. Each air spray fuel burner 20 includes a fuel inlet generally designated at 21, an air inlet generally designated at 23 and the usual pintle 25. As in conventional air spray fuel burners 20, the fuel and air mixture is discharged from the burner in a cone-like spray caused by the pintle 25, the spray being in a downstream direction into the upstream end portion of the combustion chamber 16 where combustion in the primary zone takes place.

The upstream wall 24 comprises a plurality of segments 26 arranged in abutting end-to-end relationship , each segment comprising an upstream wall portion 28 and a downstream wall portion 30 attached thereto by means of eight bolts (not shown) which pass through the wall portion 28 and engage threaded bosses 34 (FIGS. 3 and 4) on the portion 30. The wall portions 28 and 30 define between them, a chamber 36 (FIG. 2) which receives a part of the flow of cooling air from the compressor 14 through apertures (not shown) in the wall portion 28, and discharges the cooling air over the downstream face 38 of the wall portion 30, as will be described with reference to FIGS. 3 and 4. Each segment has a central aperture 40 to allow for the fuel/air mixture from each fuel burner to enter the combustion chamber 16 and each fuel burner 20 has a seal ring 42 which is located on an outer cylindrical surface of the fuel burner and between the two wall portions 28 and 30.

Referring to FIGS. 3 and 4, the downstream face 38 of the wall portion 30 has two pairs of facets 44, one pair being arranged on each side of the aperture 40, the pairs being opposed to each other and each facet being inclined at an angle to the adjacent part of the face 38.

Each facet is provided with three rows of apertures 46, the axes of which are arranged parallel to the adjacent part of the downstream face 38. Further apertures 48, 50 for the flow of cooling air are also providing in the face 38 around the central aperture 40 and the inboard and outboard faces, respectively of each wall portion 30 of each segment 26.

In operation, some of the cooling air delivered by the compressor 14 flows into the chamber 36 and flows out of through the chamber 36 and flows out of through the apertures 46 over the surface 38 of the wall portion 30 in the form of a film of cooling air (arrows B). Cooling air also flows through the apertures 48 and 50 (arrows C and D respectively) to add to the cooling effect.

This form of construction for the upstream wall enables the face 38 to be effectively cooled without having flow guiding surfaces extending into high temperature regions of the combustion chamber.

The arrangement of upstream wall may be modified within the scope of the invention, e.g. each segment may only have one apertured facet with the opposing facet associated with each fuel burner being provided on the adjacent segment, or each segment may only have one pair of opposed facets with one facet on each side of the fuel burner, the apertures 46 may be increased or decreased in number or inclined at a different angle, the apertures 48 and 50 may be dispensed with and additional cooling apertures may be provided in the faces 52.

With suitable modifications, this form of upstream wall can be applied not only to annular type combustion chambers but also to can-type and can-annular type chambers.

We claim:

1. A gas turbine engine combustion chamber comprising:

an upstream wall member including an upstream wall portion and a spaced downstream wall portion having a downstream face, said upstream wall portion and said spaced downstream wall portion defining a chamber therebetween arranged to receive a flow of cooling air and to discharge the flow of cooling air therefrom, at least one air spray fuel burner extending through said upstream wall member for discharging in a downstream direction into the combustion chamber a cone-shaped spray of fuel and air mixture, at least a pair of facets on said downstream wall portion, said facets being set at an angle to the downstream face of said downstream wall portion, one of said pair of facets being positioned on one side of and spaced from said air spray fuel burner and the other of said pair of facets being positioned on the other side of and spaced from said air spray fuel burner, each of said pair of facets having a plurality of apertures for the flow of cooling air from said chamber to said downstream wall, said apertures in each facet being aligned to direct a flow of cooling air across a width of the downstream face of said downstream wall portion in a direction generally parallel to a part of the downstream wall portion adjacent the respective facet and in a direction toward said air spray fuel burner to cause the cooling air to directly interact with the spray of fuel and air mixture therefrom whereby combustion in a primary zone of the combustion chamber is improved.

2. A combustion chamber as claimed in claim 1 in which said downstream wall portion comprises a plurality of segments, adjacent segments being in abutting relationship with one another to form an annulus, each segment being provided with at least a pair of opposed facets and each segment having at least one air spray fuel burner extending therethrough with one facet being located on one side of the air spray fuel burner and the other facet being located on the other side of the air spray fuel burner.

3. A combustion chamber as claimed in claim 2 in which each segment has a pair of facets on each side of said air spray fuel burner, the cooling air from the apertures in one pair of facets being arranged to flow in opposition to the cooling air flowing from the apertures in the other pair of facets with the cooling air from both pairs of facets flowing toward the air spray fuel burner.

4. A combustion chamber as claimed in claim 1 in which the apertures in each facet are formed parallel to the downstream face of the downstream wall portion adjacent the said facet.

5. A combustion chamber as claimed in claim 1 including further apertures in said downstream wall portion for the through flow of cooling air from said chamber.

6. A combustion chamber as claimed in claim 5 in which said downstream wall portion has a central portion and in which at least some of said further apertures are provided adjacent said central portion.

7. A combustion chamber as claimed in claim 5 in which said downstream wall portion has edge faces and in which at least some of said further apertures are provided in said edge faces.

8. A combustion chamber as claimed in claim 1 in which the chamber is a can-type combustion chamber.

9. A combustion chamber as claimed in claim 1 in which the chamber is a can-annular type of combustion chamber.

10. A combustion chamber as claimed in claim 1 in which the chamber is an annular type of combustion chamber.

* * * * *